US006668693B2

(12) United States Patent
Niada

(10) Patent No.: US 6,668,693 B2
(45) Date of Patent: Dec. 30, 2003

(54) MECHANISM FOR PAPER TOWEL DISPENSERS

(75) Inventor: Gianandrea Niada, Milan (IT)

(73) Assignee: QTS S.r.l., Brugherio (IT)

( * ) Notice: Subject to any disclaimer, the term of this patent is extended or adjusted under 35 U.S.C. 154(b) by 262 days.

(21) Appl. No.: 09/840,352

(22) Filed: Apr. 23, 2001

(65) Prior Publication Data

US 2001/0038024 A1 Nov. 8, 2001

(30) Foreign Application Priority Data

May 8, 2000 (EP) ..... 00201639

(51) Int. Cl.[7] ..... B26D 1/56

(52) U.S. Cl. ..... 83/304; 83/337; 83/339; 83/649

(58) Field of Search ..... 83/337, 338, 339, 83/304, 305, 649, 650; 252/60, 61

(56) References Cited

U.S. PATENT DOCUMENTS 3,057,239 A * 10/1962 Teplitz ..... 83/337
3,641,857 A * 2/1972 Vande Castle ..... 83/322
3,943,686 A * 3/1976 Crawford et al. ..... 83/338
4,307,639 A * 12/1981 DeLucas ..... 83/337
5,441,189 A * 8/1995 Formsn et al. ..... 83/337
5,937,718 A * 8/1999 Granger ..... 83/337
6,105,479 A * 8/2000 Neier et al. ..... 83/304
6,112,631 A * 9/2000 VanAlstine ..... 83/337
6,363,824 B1 * 4/2002 Granger ..... 83/337
6,443,043 B1 * 9/2002 Granger ..... 83/649

* cited by examiner

*Primary Examiner*—Kenneth E. Peterson
*Assistant Examiner*—Omar Flores-Sánchez
(74) *Attorney, Agent, or Firm*—Akin, Gump, Strauss, Hauer & Feld, L.L.P.

(57) ABSTRACT

Mechanism for cutting and distributing portions of sheet, particularly paper towels, comprising at least one cylinder (9) which can rotate around its axis in a supporting structure (1, 2, 3) and drag an end portion (8) of at least one sheet, inside said cylinder (9) being arranged one or more movable blades (28) which can protrude outside the cylinder (9) for cutting said end portion (8) of the sheet and are fixed to a shaft (26) suitable for rotating around an axis parallel to the longitudinal axis of the cylinder (9), wherein said shaft (26) is provided with at least a first member (30) which protrudes from one side of the cylinder (9) and can be rotated for an arc of a circumference by at least a second member (25) which shifts in a direction parallel to the longitudinal axis of the shaft (26) of the movable blades (28) and rotates around this axis, the rotational-translational motion of this second member (25) being synchronized with the rotatory motion of the cylinder (9). The present invention also relates to a paper towel dispenser comprising said mechanism.

17 Claims, 4 Drawing Sheets

MECHANISM FOR PAPER TOWEL DISPENSERS

BACKGROUND OF THE INVENTION

The present invention relates to a mechanism for paper towel dispensers, and particularly to a mechanism suitable for cutting and distributing sheets of paper or of another material after taking them from a roll. The present invention also relates to a paper towel dispenser comprising said mechanism.

EP 871390 discloses a mechanism for paper towel dispensers comprising a cutting device having at least one movable blade arranged inside a cylinder, which drags the sheet of paper taken from a roll. However, said known mechanism involves a considerable manufacture and maintenance complexity, as well as a non-efficient functioning of the cutting device, with risk of jamming of the mechanism itself.

BRIEF SUMMARY OF THE INVENTION

Object of the present invention is therefore to provide a mechanism which is free from said drawbacks. Said object is achieved by a mechanism, the main features of which are specified in the first claim and other features are specified in the following claims.

By virtue of the particular rotational-translational drive system which it is provided with, the cutting device of the mechanism according to the present invention has a precise and fluent movement of the blades outwards from the cylinder.

Further, thanks to the pair of mutually engaged toothed wheels and to the guides of the supporting structure, said movement of the blades is perfectly synchronized with that one of the cylinder, so as to avoid the mechanism jamming.

According to a particular aspect of the invention, the translatory movement of the member transmitting the rotation to the movable blades is caused by a pair of relieves made inside the supporting structure of the cylinder, so as to obtain a precision of movement without complex and/or expensive guides.

BRIEF DESCRIPTION OF THE SEVERAL VIEWS OF THE DRAWINGS

Further advantages and features of the mechanism according to the present invention will appear to those skilled in the art from the following detailed and non-limiting description of one embodiment thereof with reference to the accompanying drawings, wherein.

DETAILED DESCRIPTION OF THE INVENTION

Figure 1:
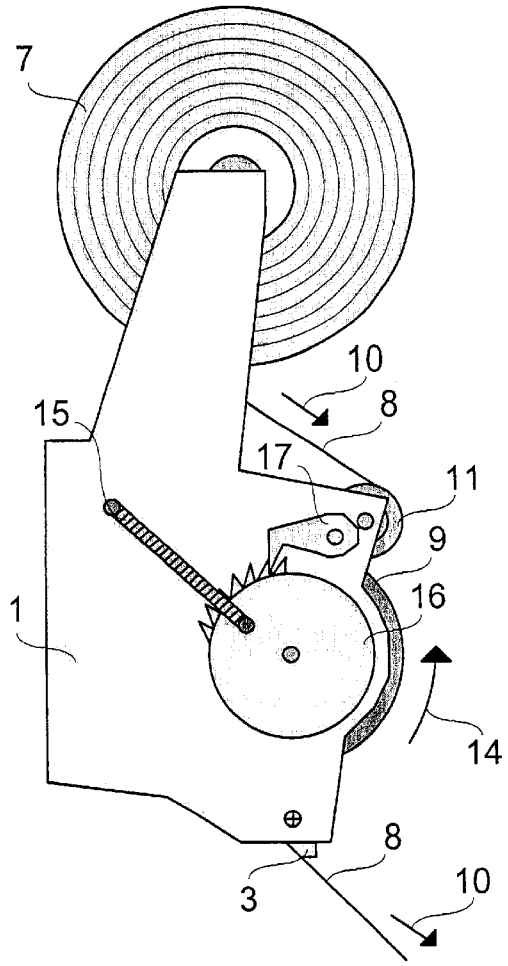
FIG. 1 shows a left side view of the mechanism according to said embodiment.
Figure 2:
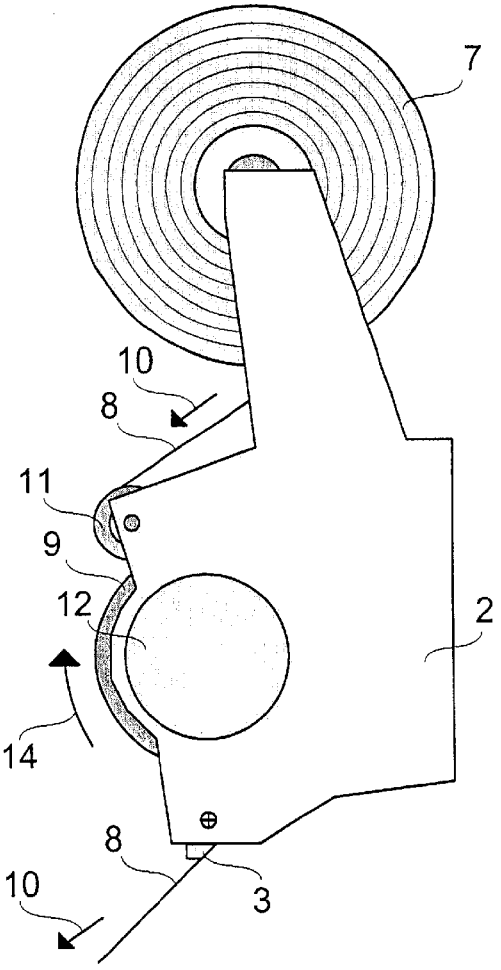
FIG. 2 shows a right side view of the mechanism of FIG. 1.
Figure 3:
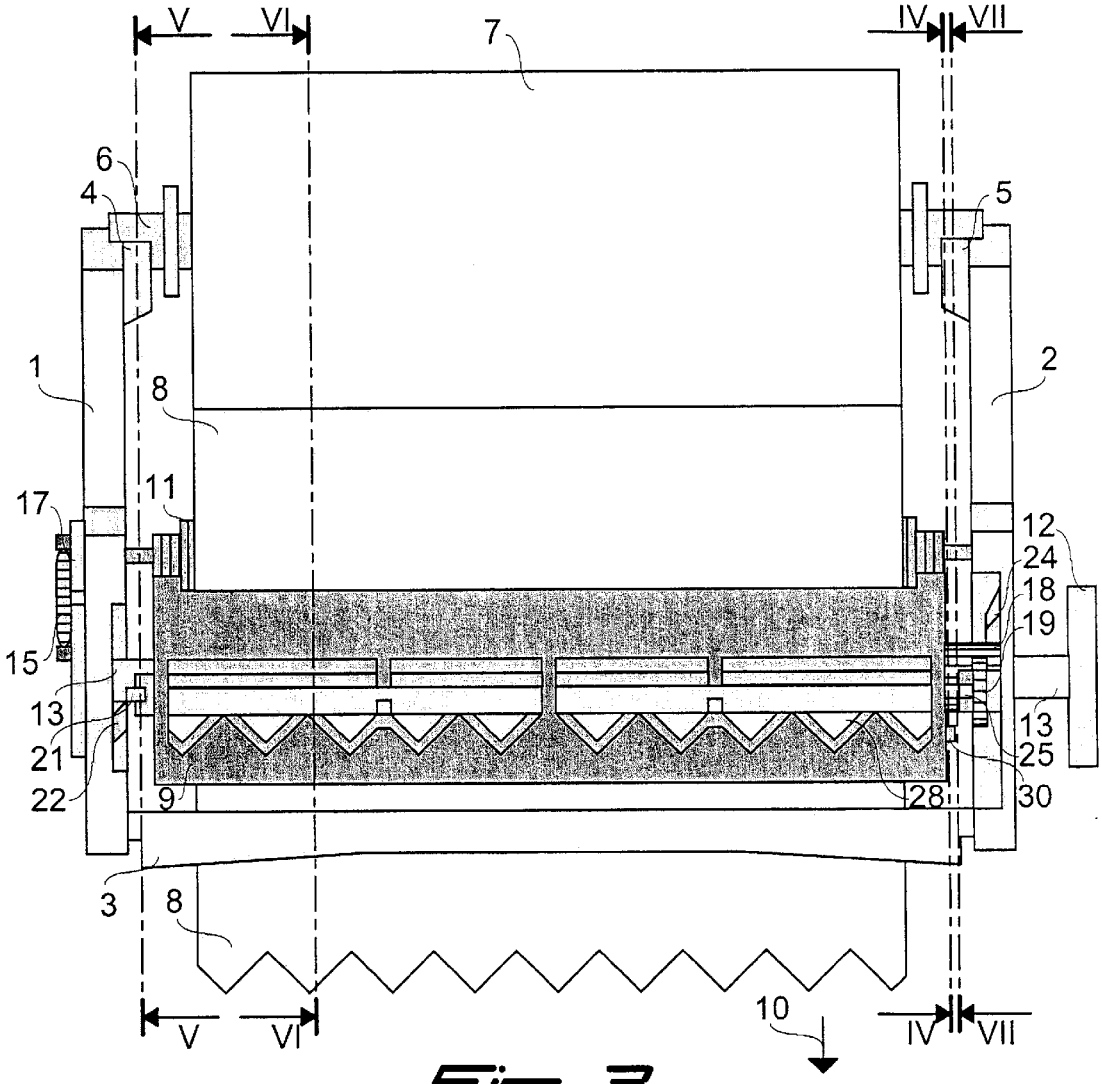
FIG. 3 shows a front view of the mechanism of FIG. 1.

With reference to FIGS. 1 to 3, it is seen that the mechanism according to said embodiment of the invention comprises in a known way a supporting structure formed of a pair of side walls 1, 2 mutually connected by means of at least one profiled transverse bar 3 acting as a lower guide. This supporting structure can be mounted inside a housing (not shown in the figure). The upper portion of side walls 1, 2, is provided with a pair of semi-cylindrical seats 4, 5 wherein the ends of a tube 6 can rotate, around which at least one sheet of paper or other material is wound so as to form a roll 7. The end portion 8 of this sheet passes around a cylinder 9 parallel to tube 6 and protrudes under transverse bar 3, so that it can be pulled by a user in the direction indicated by arrows 10. End portion 8 of the sheet is guided around cylinder 9 by an idle cylinder 11 parallel thereto. Cylinder 9 can be rotated between side walls 1, 2 by manually pulling end portion 8 of the sheet or by rotating a round handle 12 which is arranged outside side wall 2. This round handle is fixed to one external end of a pair of hubs 13 which are fixed in a coaxial way to the lateral surfaces of cylinder 9 and which cross walls 1, 2. The rotation of cylinder 9, which occurs in the direction indicated by arrows 14, is opposed for a half-turn and then pushed for the other half-turn by a tension spring 15 fixed between side wall 1 and a disk 16 which is partially toothed with oblique teeth. This disk is fastened to the external end of a hub 13 of cylinder 9 and is arranged outside wall 1. After performing one turn around its axis, disk 16 is blocked by a spike 17 hinged to wall 1 so as to oppose the contrary rotation thereof. By this ratchet gear, cylinder 9 can be easily rotated of one turn at a time when end portion 8 of the sheet is pulled or handle 12 is rotated.

Figure 4:
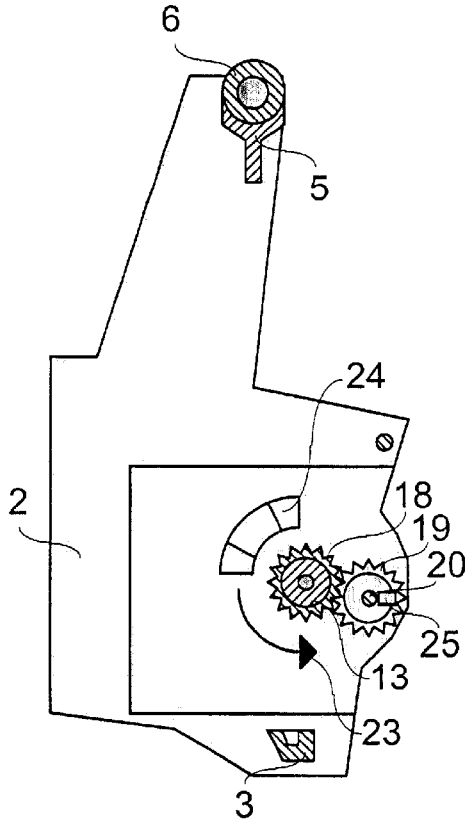
FIG. 4 shows a side cross-sectioned view of the mechanism of FIG. 3 taken along plane IV—IV.
Figure 5:
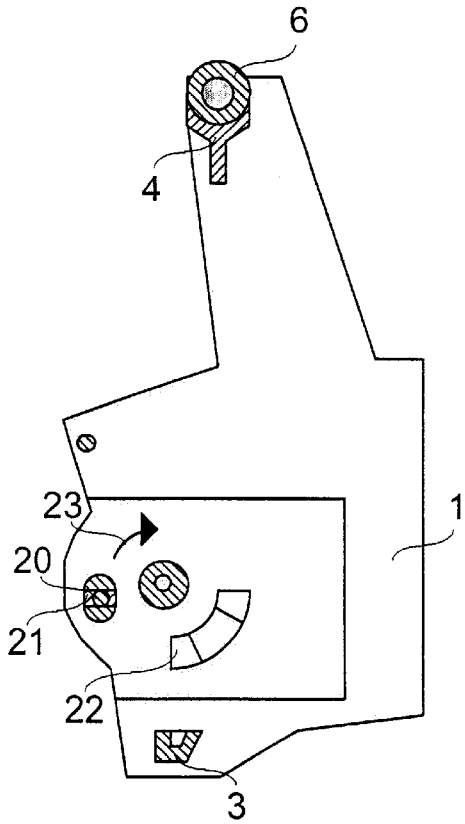
FIG. 5 shows a side cross-sectioned view of the mechanism of FIG. 3 taken along plane V—V.

With reference also to FIGS. 4 and 5, there is shown that one hub 13 of cylinder 9 can rotate coaxially inside a cylindrical toothed wheel 18, having internal or external teeth, which is fixed to the internal surface of wall 2 and is engaged with another cylindrical toothed wheel 19 having the same number of teeth or a whole submultiple thereof. The toothed wheel 19 can slide along the internal surface of wall 2 and is arranged at one end of a rod 20 which longitudinally crosses cylinder 9 and can slide therein. The other end of rod 20 is provided with a skid 21 which can slide along the internal surface of wall 1.

The internal surface of side wall 1 is suitably provided with at least one relief 22 which acts as a guide and has a gradually varying thickness, so that skid 21, by sliding along this wall in the sense indicated by arrows 23, shifts rod 20 horizontally inside cylinder 9 towards side wall 2. Particularly, relief 22 extends itself for about one quarter of a circumference coaxially with the longitudinal axis of cylinder 9. Even the internal surface of side wall 2 is suitably provided with at least one relief 24 which acts as a guide and has a gradually varying thickness, so that the toothed wheel 19, by sliding along this wall in the sense indicated by arrows 23, shifts rod 20 horizontally inside cylinder 9 towards side wall 1. Also relief 24 extends itself for about one quarter of a circumference coaxially with the longitudinal axis of cylinder 9, but in the preceding quadrant of that of relief 22 in the sense of arrows 23. Therefore, by means of relieves 22 and 24 it is possible to slide horizontally rod 20 and toothed wheel 19 with an alternated motion synchronized with the rotary motion of the cylinder itself. A pin 25 is fastened to the lateral surface of the toothed wheel 19 turned towards cylinder 9.

Figure 6:
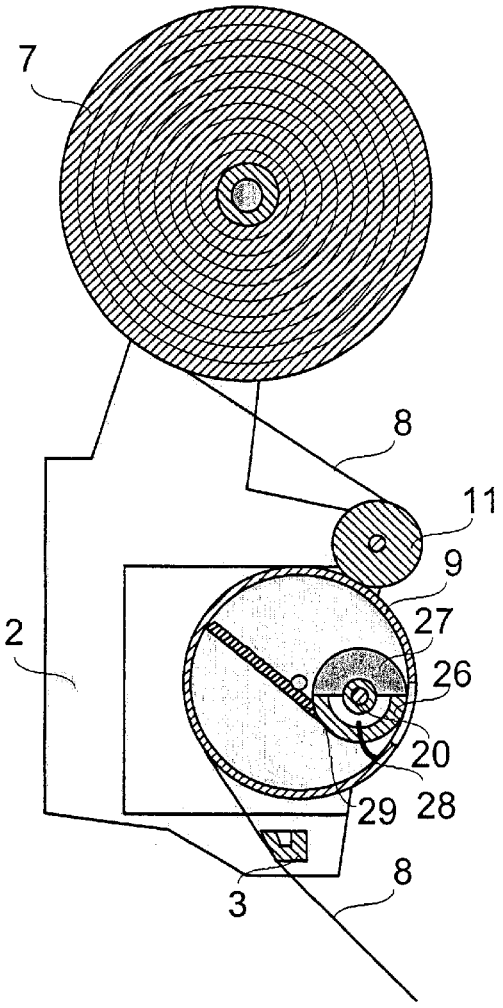
FIG. 6 shows a side cross-sectioned view of the mechanism of FIG. 3 taken along plane VI—VI.

Referring also to FIG. 6, it is seen that a shaft 26 is arranged coaxially around rod 20 and can rotate parallely to the longitudinal axis of cylinder 9 in a set of eccentric round seats 27 made in disks arranged inside the cylinder itself. One or more movable blades 28, preferably curved and provided with triangular points, are fixed to shaft 26. Through suitable openings made in the cylindrical surface of cylinder 9, these blades can protrude outwards. This is achieved by rotating shaft 26 around its axis against the force exerted by a tension spring 29 arranged inside cylinder 9.

Figure 7:
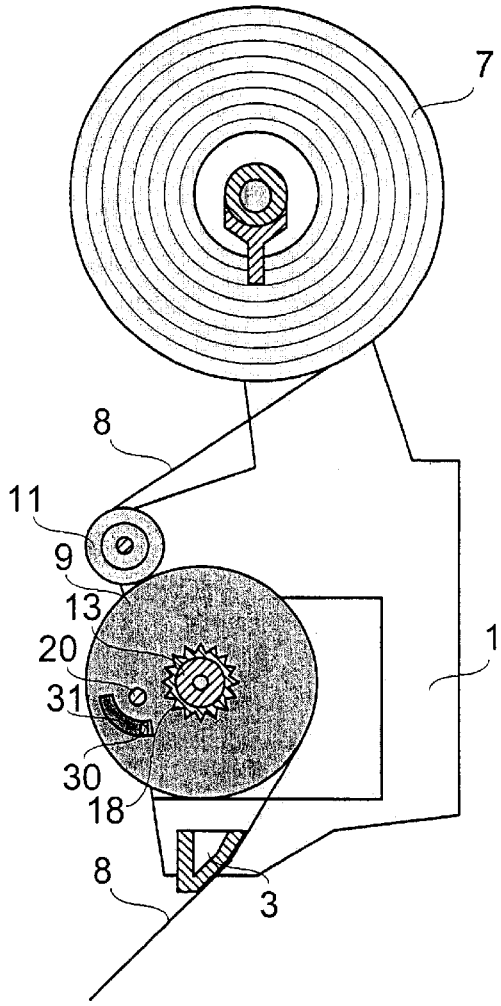
FIG. 7 shows a side cross-sectioned view of the mechanism of FIG. 3 taken along plane VII—VII.

With reference also to FIG. 7, it is seen that the end of shaft 26 turned towards wall 2 is provided with a pin 30 protruding from a side wall of cylinder 9 through an opening 31 which extends for about one quarter of a circumference coaxially with the longitudinal axis of shaft 26.

During the use, the end portion 8 of the sheet wound around roll 7, when a user pulls it, proceeds in the direction of arrows 10, thus rotating cylinder 9 in the direction of arrows 14. During the rotation of cylinder 9, toothed wheel 19 rotates around its axis and horizontally shifts along the latter towards side wall 1. When toothed wheel 19 is positioned along relief 24, pin 25 abuts against pin 30, thus dragging it therewith. By this measure, shaft 26 rotates for about a quarter of a circumference, thereby extending out of cylinder 9 blades 28, which cut the end portion 8 of roll 7.

When toothed wheel 19 is over relief 24, skid 21 slides along relief 22 and shifts rod 20 towards side wall 2, thus separating pin 25 of toothed wheel 19 from pin 30 of shaft 26. By this measure, shaft 26 is made free and rotated backwards by spring 29 which withdraws inside cylinder 9 blades 28, so that these cannot hit idle cylinder 11 during the rotation of cylinder 9. A new sheet end portion 8 is dragged under profiled bar 3 by final movement of cylinder 9 due to spring 15, so that the mechanism according to the present invention can be used again in the above described way.

What is claimed is:

1. Mechanism for cutting and dispensing portions of sheets, comprising at least one cylinder (9) which can rotate around its axis in a supporting structure (1, 2, 3) and drag an end portion (8) of at least one sheet, inside said cylinder (9) being arranged one or more movable blades (28) which can protrude outside the cylinder (9) for cutting said end portion (8) of the sheet and are fixed to a shaft (26) suitable for rotating around an axis parallel to the longitudinal axis of the cylinder (9), characterized in that said shaft (26) is provided with at least a first member (30) which protrudes from one side of the cylinder (9) and can be rotated for an arc of a circumference by at least a second member (25) which shifts in a direction parallel to the longitudinal axis of the shaft (26) of the movable blades (28) and rotates around this axis, the rotational-translational motion of this second member (25) being synchronized with the rotatory motion of the cylinder (9).

2. Mechanism according to claim 1, characterized in that said movable blades (28) are curved and provided with triangular points.

3. Mechanism according to claim 1, characterized in that the rotation of the shaft (26) of the movable blades (28) when these protrude from the cylinder (9) is opposed by tension elastic means (29) arranged inside the cylinder itself.

4. Mechanism according to claim 1, characterized in that said first member (30) protrudes from one side of the cylinder (9) through one opening (31) which extends itself for about on quarter of a circumference coaxially with the longitudinal axis of the shaft (26) of the movable blades (28).

5. Dispenser of towels of paper or other material wound in a roll (7), characterized in that it comprises a mechanism according to claim 1.

6. Mechanism according to claim 1, characterized in that said second member (25) is a pin fixed to one side of a first toothed wheel (19) suitable for rotating around the longitudinal axis of the shaft (26) of the movable blades (28).

7. Mechanism according to claim 6, characterized in that said first toothed wheel (19) is engaged with a second toothed wheel (18) which is fixed to said supporting structure (1, 2, 3) and is coaxial with the longitudinal axis of said cylinder (9).

8. Mechanism according to claim 7, characterized in that said toothed wheels (18, 19) have the same number of teeth.

9. Mechanism according to claim 6, characterized in that said first toothed wheel (19) is shifted with an alternated motion synchronized with the rotatory motion of the cylinder (9) along the longitudinal axis of the shaft (26) by means of one or more guides (22, 24) fixed to said supporting structure (1, 2, 3).

10. Mechanism according to claim 6, characterized in that said first toothed wheel (19) can slide along the internal surface of a side wall (2) of the supporting structure and is arranged at one end of a rod (20) which longitudinally crosses cylinder (9) and can slide therein, the other end of the rod (20) being provided with a skid (21) which can slide along the internal surface of the other side wall (1) of the supporting structure.

11. Mechanism according to claim 1, characterized in that the supporting structure (1, 2, 3) comprises a pair of side walls (1, 2), the internal surfaces of which are provided with relieves (22, 24) acting as guides.

12. Mechanism according to claim 11, characterized in that said relieves (22, 24) acting as guides have a gradually varying thickness and extend themselves for about one quarter of a circumference around the longitudinal axis of the cylinder (9).

13. Mechanism according to claim 11, characterized in that said side walls (1, 2) of the supporting structure are crossed by a pair of hubs (13) coaxially fixed to the lateral surfaces of the cylinder (9).

14. Mechanism according to claim 13, characterized in that the external end of a hub (13) is provided with a round handle (12).

15. Mechanism according to claim 13, characterized in that the rotation of the cylinder (9) is opposed for half of a turn and then pushed for the next half of a turn by tension elastical means (15) fixed to a side wall (1) of the supporting structure and to a rotating member (16) which is fixed to the external end of a hub (13) of cylinder (9) and is arranged externally of the side wall itself.

16. Mechanism according to claim 15, characterized in that said rotating member (16) comprises a disk partially toothed with oblique teeth, which is suitable for being blocked by a spike (17) hinged to said side wall (1) of the support structure.

17. Mechanism according to claim 10, characterized in that the shaft (26) of the blades (28) is coaxially arranged around said rod (20) and can rotate parallely to the longitudinal axis of the cylinder (9) in seats (27) made in the cylinder itself.

* * * * *